US006585496B1

(12) United States Patent
Sun

(10) Patent No.: US 6,585,496 B1
(45) Date of Patent: Jul. 1, 2003

(54) SELF-REGULATING OIL RESERVOIR FOR SCROLL COMPRESSOR

(75) Inventor: Zili Sun, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 10/057,211

(22) Filed: Jan. 24, 2002

(51) Int. Cl.[7] ..... F04B 17/00; F01M 1/00

(52) U.S. Cl. ..... 417/410.5; 417/423.13; 184/6.16

(58) Field of Search ..... 417/410.5, 423.13, 417/423.14, 372; 62/468, 469; 184/6.16, 6.18, 6.19; 418/206.8

(56) References Cited

U.S. PATENT DOCUMENTS 4,564,339 A * 1/1986 Nakamura et al. ..... 417/366
RE34,297 E 6/1993 Elson
5,336,060 A * 8/1994 Tomell et al. ..... 417/410.5
5,785,151 A * 7/1998 Fry et al. ..... 184/6.16
6,106,254 A * 8/2000 Hirooka et al. ..... 418/55.6
6,293,767 B1 * 9/2001 Bass ..... 417/310
6,386,840 B1 * 5/2002 Williams et al. ..... 417/371

* cited by examiner

*Primary Examiner*—Charles G. Freay
*Assistant Examiner*—Michael K. Gray
(74) *Attorney, Agent, or Firm*—Carlson, Gaskey & Olds

(57) ABSTRACT

A scroll compressor is provided with an oil reservoir that is self-regulating dependent on the overall lubricant level in the compressor. The reservoir is provided by a structural member having an inner rim and a bottom wall. The bottom wall is provided with a metering orifice that returns lubricant to the main sump. The metering orifice will ensure that undue amounts of lubricant are not maintained in the reservoir during low oil operation.

10 Claims, 3 Drawing Sheets

SELF-REGULATING OIL RESERVOIR FOR SCROLL COMPRESSOR

BACKGROUND OF THE INVENTION

This invention relates to the provision of an oil reservoir to regulate the amount of oil in a sump for a scroll compressor.

Scroll compressors are becoming widely utilized in refrigerant compression applications. In a scroll compressor, a pair of scroll members each have a base and a generally spiral wrap extending from the base. The wraps interfit to define compression chambers. One of the two scroll members is caused to orbit relative to the other, and as the two orbit relative to each other, the size of the compression chambers decreases, compressing an entrapped refrigerant.

Scroll compressors are typically mounted within a sealed housing. Oil is supplied from a sump near the bottom of the housing upwardly through a drive shaft to the relatively moving surfaces. The oil lubricates the relatively moving surfaces and returns to the sump through an oil return tube.

It is desirable to have a good deal of lubricant for the relatively moving surfaces. However, providing a higher lubricant level does raise some design challenges. As an example, a scroll compressor is typically provided with a lower counterweight which may extend downwardly into a high oil level. As the counterweight rotates within the oil, there are efficiency losses.

For the above reason, it may sometimes be desirable to trap the oil in a reservoir such that the counterweight will be secluded or shielded from the reservoir. However, such a reservoir can raise design challenges if it is not able to adjust the amount of lubricant stored in the reservoir in response to the overall lubricant level. As an example, if the oil level is low for some reason, it would not be desirable to trap a large amount of lubricant within the reservoir, as there may then be insufficient lubricant for lubricating the relatively moving surfaces.

SUMMARY OF THE INVENTION

In the disclosed embodiment of this invention, a lubricant reservoir is provided adjacent the lower end of the motor for a scroll compressor. The lubricant reservoir is provided with an orifice which meters lubricant back to the main sump. During operation with a relatively high level of lubricant, the lubricant retained in the reservoir will provide a lower overall oil level such that the counterweight is not rotating within the lubricant level. Generally, the returning lubricant will be maintained in the reservoir until the reservoir becomes full. Some lubricant will be returned to the main sump through the metering orifice. Further, if the level is sufficiently high, other lubricant may spill over the top of the reservoir and return to the main sump. Preferably, all of this returning lubricant will be sufficiently separated from the path of the counterweight such that the above-referenced efficiency losses will not occur.

At a lower lubricant level, the metering orifice will ensure that the oil is returned to the main sump, and that a large amount of oil is not stored in the reservoir. Thus, the present invention provides an oil reservoir which is self-regulating such that during low lubricant levels, the reservoir stores little or no lubricant such that available lubricant is directed into the main sump for lubricating the relatively moving surfaces.

These and other features of the present invention can be best understood from the following specification and drawings, the following of which is a brief description.

DETAILED DESCRIPTION OF A PREFERRED EMBODIMENT

Figure 1:
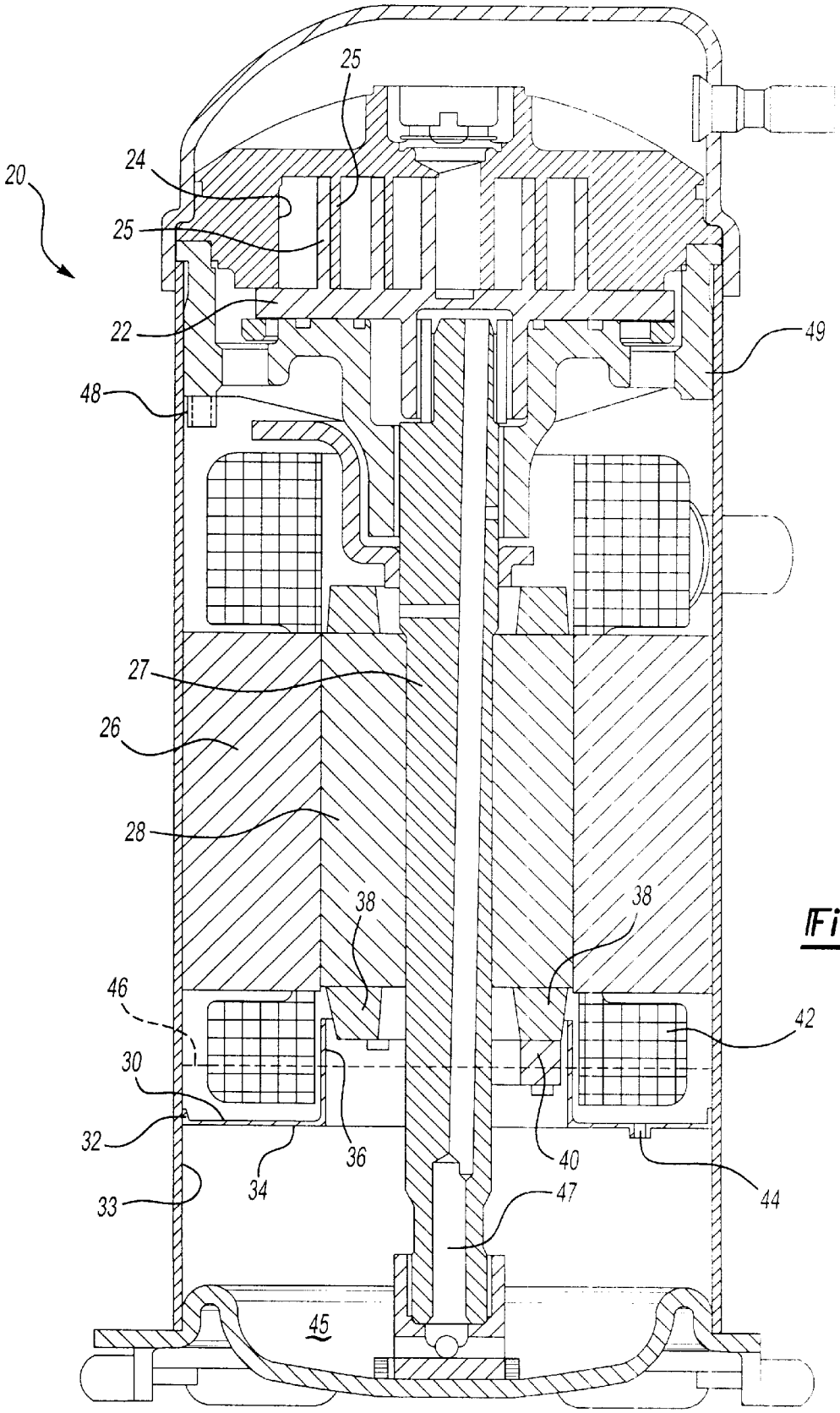
FIG. 1 shows a compressor incorporating the present invention in a non-operative state.

FIG. 1 shows a scroll compressor 20 having an orbiting scroll 22 and a non-orbiting scroll 24. As is known, wraps 25 on the two scroll members interfit to define compression chambers. A drive shaft 27 causes the orbiting scroll 22 to orbit relative to the non-orbiting scroll 24, as known. A rotor 28 is attached to the drive shaft 27 and a motor stator 26 causes the rotor 28 to rotate, driving the drive shaft 27.

An oil reservoir 30 is provided by a structure having a radially outer lip 32 sealingly abutted against an inner peripheral surface 33 of a housing. A bottom wall 34 on the reservoir extends radially inwardly to an inner rim 36. As can be seen, inner rim 36 extends axially upwardly and between an end ring 38 of the rotor 28 and the lower windings 42 from the stator 26. The lower wall 34 of the reservoir includes a bleed orifice 44 for returning lubricant to a main sump 45.

In FIG. 1, the compressor is in a non-operative state. The lubricant level 46 includes effectively all of the lubricant within the compressor. As known, during operation, lubricant travels from the sump 45 upwardly through a passage 47 in the shaft 27 and lubricates relatively moving surfaces. That lubricant then returns through a drain passage 48 formed in a crank case 49.

Figure 2:
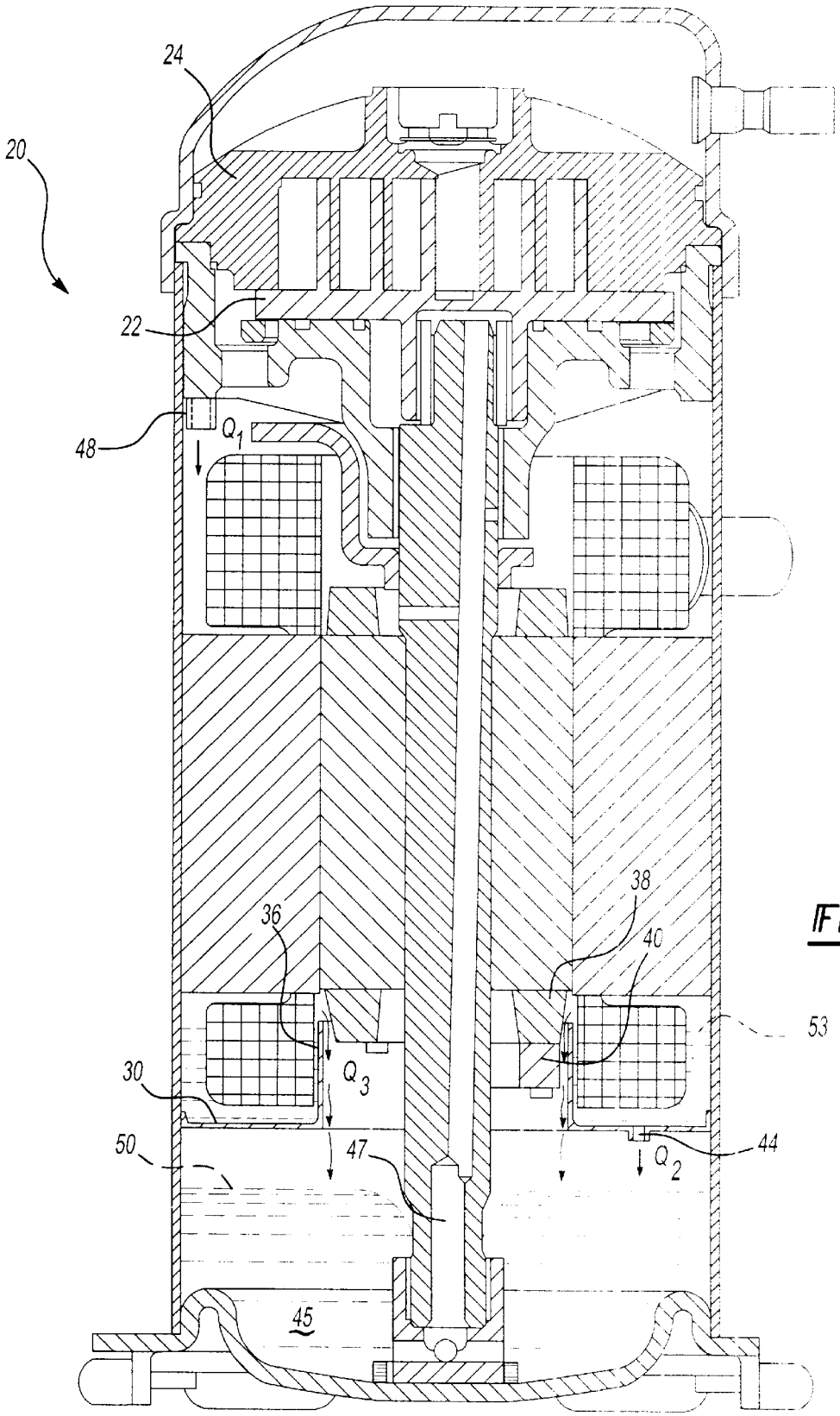
FIG. 2 shows the compressor of the present invention in a high lubricant level operating state.

As shown in FIG. 2, the compressor is now operating. Lubricant has traveled upwardly through the passage 47, and the level 50 of the lubricant in the sump 45 is lower than as shown in FIG. 1. As shown, the lubricant returning through the return passage 48 has a first volume flow Q1. This lubricant has now filled the reservoir 30 to a level 53 generally equal to the upper edge of the rim 36. Lubricant flows back to the sump 45 from the reservoir 30 in two ways with this high oil level. Initially, and while the reservoir 30 is filling, the lubricant will return through the bleed orifice 44. However, the bleed orifice 44 is limited to a flow rate of Q2. At high oil levels, Q2 will be less than Q1, and thus the reservoir will fill to the level 53 as shown in FIG. 2. At that point, additional lubricant will flow radially inwardly and over the lip 36. As shown, this lubricant flow amount Q3 combined with Q2 will equal Q1. In this way, the counterweight 40 which is attached to the lower end ring 38 is above the oil level 50, and the efficiency loss as described above will not occur.

Figure 3:
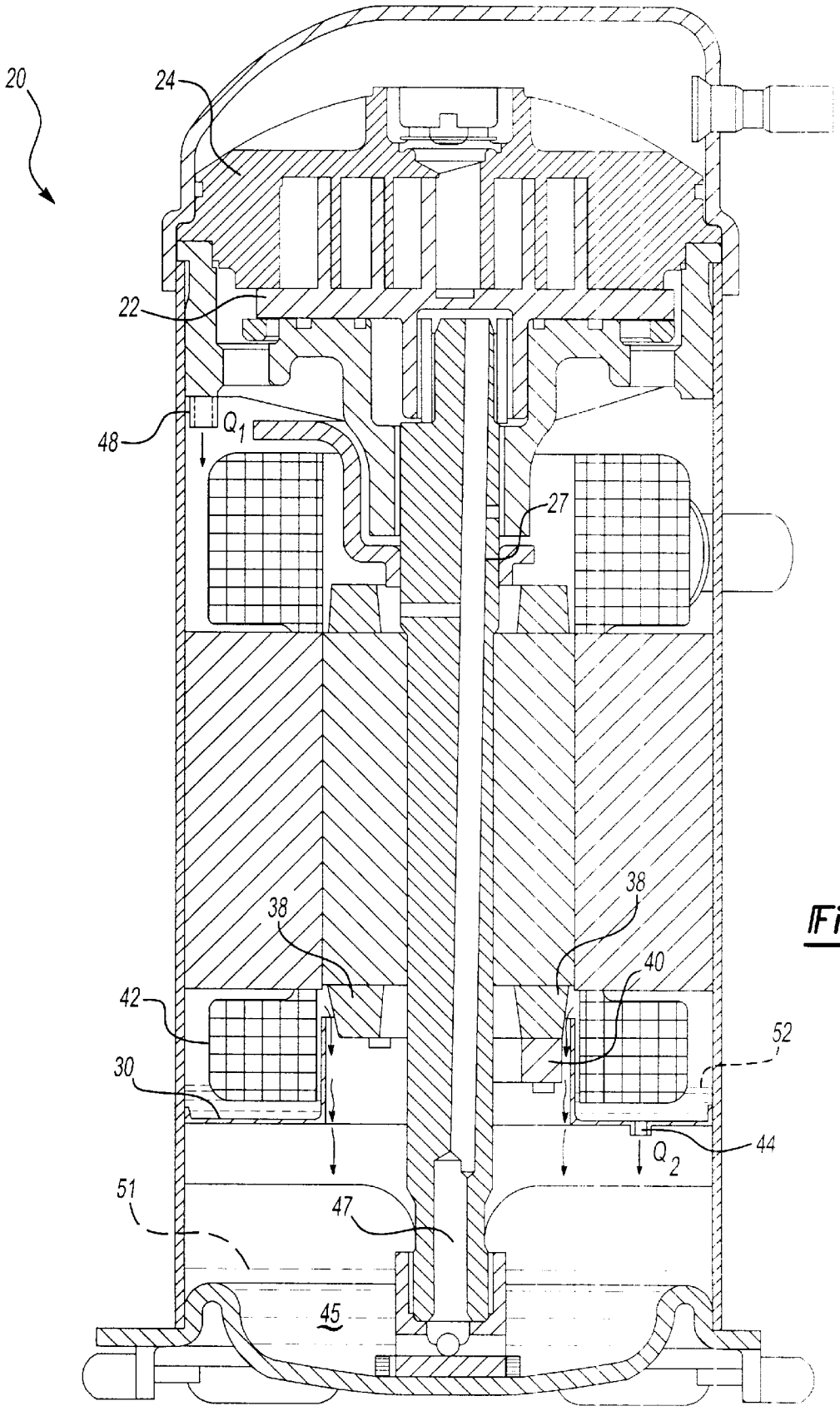
FIG. 3 shows the present invention with a low lubricant level in an operating state.

FIG. 3 shows a situation wherein the overall lubricant level in the compressor is low. This can occur, for example, if lubricant has migrated to other components within the refrigerant cycle.

In the situation shown at FIG. 3, the lubricant level 51 in the sump 45 is low. The lubricant level 52 in the reservoir is not near the top of the lip, and thus the only lubricant returning is through the bleed orifice 44. If the lubricant level is low, then the volume flow Q1 will also be low. The volume flow through the bleed orifice 44 of Q2 should be sufficient to return all of the oil Q1. In this fashion, the reservoir does not "trap" an undue amount of lubricant such as could compromise the operation of the compressor when there is a low oil level in the compressor.

Thus, the present invention provides an oil reservoir which is self-regulating to adjust the amount of stored lubricant dependent upon the overall lubricant level in the compressor.

Although the sealed compressor in the disclosed embodiments is a scroll compressor, it should be understood that other sealed compressors could benefit from this invention.

Although a preferred embodiment of this invention has been disclosed, a worker of ordinary skill in this art would recognize the modifications would come within the scope of this invention. For that reason the following claims should be studied to determine the true scope and content of this invention.

What is claimed is:

1. A sealed compressor comprising:

a sealed housing;

a compressor pump unit mounted adjacent one end of said sealed housing;

an electric motor having a stator and a rotor, said stator being provided with windings adjacent a lower end of said housing spaced from said compressor pump unit, said rotor having a lower counterweight attached to said rotor to be driven with said rotor;

a shaft connected to said rotor and extending to be operatively connected to said compressor pump unit, said shaft extending downwardly beyond said motor toward said lower end of said housing;

a lubricant main sump provided in said housing at said lower end; and a lubricant reservoir provided by a structural member having a lower wall with a bleed orifice such that lubricant in said reservoir can return through said bleed orifice to said main sump.

2. A sealed compressor as recited in claim 1, wherein said structural member includes an outer surface in sealed contact with an inner wall of said housing.

3. A sealed compressor as recited in claim 2, wherein said outer surface extends axially upwardly to form a lip which is in contact with said inner wall.

4. A sealed compressor as recited in claim 1, wherein a radially inner rim is formed on said structural member, said radially inner rim extending axially upwardly above an axially lowermost end of said windings.

5. A sealed compressor as recited in claim 4, wherein said rotor has a lower end ring, and said rim extending axially upwardly at a position radially intermediate said lower end ring and said lower winding.

6. A sealed compressor as recited in claim 5, wherein said counterweight is attached to said end ring.

7. A sealed compressor as recited in claim 1, wherein said compressor pump unit is a scroll compressor.

8. A sealed scroll compressor comprising:

a sealed housing;

a scroll compressor pump unit mounted adjacent one end of said sealed housing;

an electric motor having a stator and a rotor, said stator being provided with windings adjacent a lower end of said housing spaced from said scroll compressor pump unit, said rotor having a lower counterweight attached to said rotor to be driven with said rotor;

a shaft connected to said rotor and extending to be operatively connected to said scroll compressor pump unit, said shaft extending downwardly beyond said motor toward said lower end of said housing;

a lubricant main sump provided in said housing at said second end; and a lubricant reservoir provided by a structural member positioned adjacent said second end of said stator, said structural member having a lower wall with a bleed orifice such that lubricant in said reservoir can return through said bleed orifice to said main sump, said structural member having a radially outer surface in sealed contact with an inner wall of said housing, and a radially inner rim formed on said structural member extending axially upwardly above an axially lowermost end of said windings, said rotor having a lower end ring and said rim extending axially upward at a position radially intermediate said end lower end ring and said lower windings.

9. A sealed compressor as recited in claim 8, wherein said outer surface extends axially upwardly to form a lip which is in contact with said inner wall.

10. A sealed compressor as recited in claim 8, wherein said counterweight is attached to said end ring.

* * * * *